US010156371B2

(12) United States Patent
Mantegazza

(10) Patent No.: US 10,156,371 B2
(45) Date of Patent: Dec. 18, 2018

(54) REFRIGERATION APPARATUS

(71) Applicant: M.T.A. S.p.A., Conselve (IT)

(72) Inventor: Mario Mantegazza, Casalserugo (IT)

(73) Assignee: M.T.A. S.P.A., Conselve (IT)

( * ) Notice: Subject to any disclaimer, the term of this patent is extended or adjusted under 35 U.S.C. 154(b) by 302 days.

(21) Appl. No.: 14/897,316

(22) PCT Filed: Jun. 11, 2014

(86) PCT No.: PCT/IB2014/062137

§ 371 (c)(1),
(2) Date: Dec. 10, 2015

(87) PCT Pub. No.: WO2014/199317

PCT Pub. Date: Dec. 18, 2014

(65) Prior Publication Data

US 2016/0146478 A1 May 26, 2016

(30) Foreign Application Priority Data

Jun. 11, 2013 (IT) ..... PD2013A0166

(51) Int. Cl.

| | |
|---|---|
| ***F24F 3/14*** | (2006.01) |
| ***F25B 41/04*** | (2006.01) |
| ***F25B 13/00*** | (2006.01) |
| *F25B 25/00* | (2006.01) |
| *F25B 49/02* | (2006.01) |

(52) U.S. Cl.

CPC ..... *F24F 3/14* (2013.01); *F25B 13/00* (2013.01); *F25B 41/04* (2013.01); *F25B 41/043* (2013.01); *F24F 2003/1446* (2013.01); *F25B 25/005* (2013.01); *F25B 49/02* (2013.01)

(58) Field of Classification Search

CPC ... F25B 41/01; F25B 13/00; F24F 3/14; F24F 2003/144; F24F 2003/1446; F24F 2003/1452; F24F 2203/03; F16K 27/0236

See application file for complete search history.

(56) References Cited

FOREIGN PATENT DOCUMENTS

| | | |
|---|---|---|
| EP | 1039250 | 9/2000 |
| GB | 1057721 | 2/1967 |
| GB | 1461545 | 1/1977 |
| JP | 5 52430 | 3/1993 |
| JP | 10 62018 | 3/1998 |

OTHER PUBLICATIONS

JPH1062018 Translation.*

International Search Report for PCT/IB2014/062137 dated Sep. 1, 2014.

* cited by examiner

*Primary Examiner* — Brian King

(74) *Attorney, Agent, or Firm* — Stradley Ronon Stevens & Young, LLP

(57) ABSTRACT

Apparatus for the cooling of a process fluid. The apparatus comprises a process fluid circuit along which there are provided in succession a compressor, a condenser, a first throttling member and an evaporator which can effect heat exchange with a fluid requiring treatment, and a regulating device. The regulating device includes an inlet chamber and an outlet chamber, and a calibrated passage hole which provides further communication between the inlet chamber and the outlet chamber in addition to a main passage.

20 Claims, 3 Drawing Sheets

REFRIGERATION APPARATUS

RELATED APPLICATIONS

The present application is a U.S. national phase application of International Application No. PCT/IB2014/062137 filed on Jun. 11, 2014, which claims the benefit of priority to Italian Patent Application Number PD2013A000166, filed on Jun. 11, 2013, the contents of which are incorporated in this application by reference.

TECHNICAL FIELD

This invention relates to apparatus for the treatment of a gas, in particular intended to reduce the humidity of a flow of moist compressed air, comprising an electrically operated valve.

BACKGROUND OF THE INVENTION

In the context of technical systems for the treatment of compressed gases the use of cooling circuits to reduce the temperature of the gas in order to separate it from its moist component is known.

These cooling circuits typically comprise a compressor, a condenser, a throttling member and an evaporator which exchanges heat with the fluid being treated in order to reduce its temperature.

In the cooling circuits used in systems for drying moist air it is desirable to control the quantity of heat exchanged by the cooling circuit on the basis of the temperature and the flow of the incoming air that has to be dried. In addition to this it will be readily understood that in these applications the parameters of the air which has to be treated readily change on the basis of working conditions or over the period of a day.

The cooling circuits, which are typically dimensioned on the basis of the maximum required load, will exchange an excessive quantity of heat when the system is operating under reduced load.

This excessive heat exchange gives rise to two main disadvantages—an excessive reduction in the temperature of the gas which has to be treated and a parallel waste of energy due to the fact that the work of the compressor is not consequently reduced. In this respect it will also be understood that in a system of this type the operating parameters, such as for example the pressure increase brought about by the compressor or the heat exchanges taking place in the condenser and the evaporator, cannot be varied freely but are defined by the design characteristics of the system. Also there is no possibility of switching the compressor off and then switching it on again at short intervals, as a non-negligible period of time is required between stopping and re-starting the compressor.

One of the ways used to control the heat load produced by the dryer in relation to the demand for dried compressed air comprises providing a loss of head in the cooling fluid upstream of the compressor.

A by-pass branch equipped with a throttle device towards which the cooling flow is diverted after a suitable valve has been switched is used for this purpose. These systems are typically provided with a control unit that activates the by-pass branch when predetermined conditions, of temperature for example, have been fulfilled, thus enabling the system to operate under a condition of maximum cooling or under a condition of relatively reduced cooling. (By "predetermined" is meant determined beforehand, so that the predetermined characteristic (e.g., conditions) must be determined, i.e., chosen or at least known, in advance of some event.) The use of such by-pass branches increases the complexity of the circuit, however, and as a consequence also increases its overall dimensions.

Furthermore the head loss introduced in the by-pass branch cannot always be controlled precisely and therefore does not allow the cooling capacity of the system to be accurately managed, given that the production process for manufacturing the valve/capillary complex involves intrinsic manufacturing difficulties.

In such applications provision for the use of valves which comprise an integrated by-pass branch, such as for example that described in patent JP-H10-62018, is also known.

The technical problem underlying this invention is that of providing apparatus for drying gas which is structurally and functionally designed to make it possible to overcome the abovementioned disadvantages in relation to the known art.

SUMMARY OF THE INVENTION

This problem is resolved by the apparatus according to the present invention. In one embodiment, the apparatus for the dehumidification of a gas comprises a cooling circuit for a process fluid along which are successively arranged: (1) a compressor; (2) a condenser; (3) a first throttling member; (4) an evaporator which forms a heat exchanger for performing a heat exchange with the gas to be treated, so as to dehumidify the latter; and (5) a regulating device having an inlet chamber and an outlet chamber, a main process fluid passage, which can be selectively closed by a movable shutter, being formed between the inlet chamber and the outlet chamber. The regulating device has a calibrated passage aperture which provides additional communication between the inlet chamber and the outlet chamber. The inlet chamber extends around the perimeter of the outlet chamber. The inlet and outlet chambers are connected to a corresponding inlet section and an outlet section which can be connected to the process fluid circuit. The inlet chamber and the outlet chamber are separated from each other by a distributor disc which has a central opening facing the outlet chamber and a plurality of peripheral holes facing the inlet chamber.

In another embodiment, the present invention comprises a drying system for compressed gases. The system includes an apparatus for the dehumidification treatment of a gas and a drying device. The drying device has an inlet for the gas being treated, an outlet for the treated gas, and a heat exchanger defined by an evaporator and a condensate separator provided at the outlet from the exchanger.

This invention offers a number of significant advantages. The main advantage lies in the fact that the apparatus according to this invention makes it possible to control the temperature of the gas being treated, at the same time bringing about a reduction in energy consumption, without requiring additional components in comparison with known systems which are structurally complex or costly.

In addition to this, implementation of this invention is industrially simple and makes it possible to achieve precise modulation of cooling capacity in a reliable way at reasonable cost.

BRIEF DESCRIPTION OF THE DRAWING

Other advantages, features and manners of use of this invention will be apparent from the following detailed description of a number of embodiments provided by way of example and without limitation. Reference will be made to the figures in the appended drawings, in which.

DETAILED DESCRIPTION OF THE INVENTION

Figure 1:
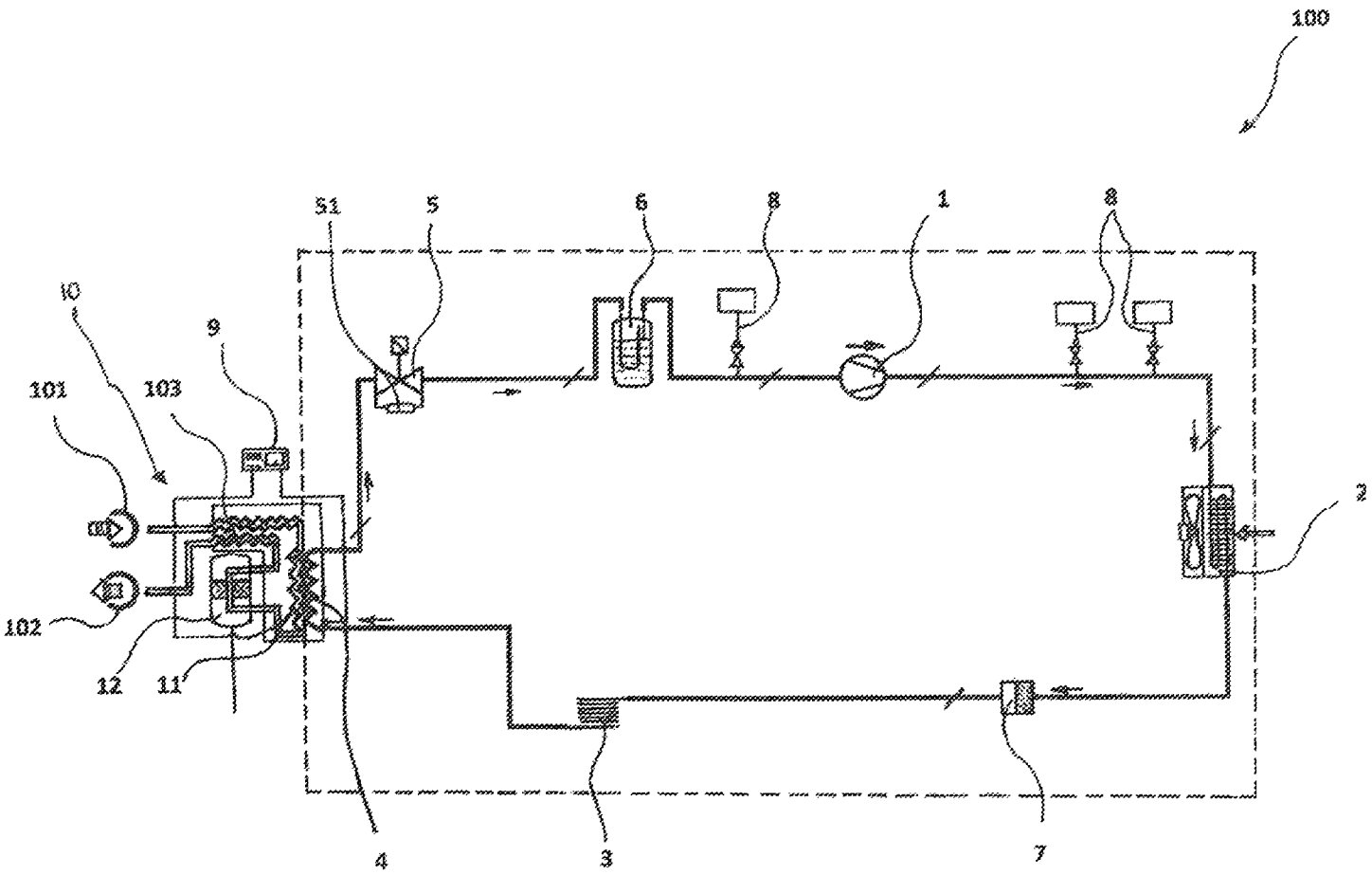
FIG. 1 is a diagram illustrating a device for drying moist gas used in association with an apparatus for cooling a process fluid according to an embodiment of this invention.

With reference initially to FIG. 1, an apparatus for the cooling of a process fluid is indicated diagrammatically as a whole by the number 100, and is intended to be used in association with a drying device 10 for the treatment of compressed gas requiring dehumidification. Overall, apparatus 100 and drying device 10 form a system for the drying of compressed gases.

Drying device 10 comprises an inlet 101 and an outlet 102 for the air or other fluid that has to be treated.

Device 10 comprises a heat exchanger 11 in which the air exchanges heat with a process fluid originating from apparatus 100. Preferably heat exchange between the two flows of process fluid and gas requiring treatment takes place counter-currently. It will also be noted that the heat exchanger 11 forms a common part with apparatus 100, which acts as an evaporator, indicated by reference number 4, following heat exchange between the gas being treated and the process fluid. On leaving the heat exchanger 11 the gas will therefore be cooled to the required dew point in order to be delivered to a condensate separator 12 in which the wet component present in the gas being treated is separated out.

On leaving condensate separator 12 the gas follows a return path to be delivered to a gas-gas exchanger 103, where further heat exchange takes place between the inlet gas flow and the outlet flow.

As previously mentioned, apparatus 100 according to one embodiment of this invention can be used to cool a process fluid, and this is made use of in drying device 10 to achieve a predetermined dew point for the gas being treated.

It is however obvious that these concepts which will be described below can also be used for different applications.

Apparatus 100 comprises a circuit for the process fluid along which there are provided in succession a compressor 1, a condenser 2, a first throttling member 3 and the evaporator 4.

It will be noted that the abovementioned components form a cooling circuit. The process fluid, for example a refrigerant fluid such as R134a, is compressed in compressor 1, bringing it to a pressure of value $p_1$ and subsequently bringing it to a condition equal to or close to that of a saturated liquid through condensation at constant pressure in condenser 2. At the outlet from the condenser 2 the fluid is choked in first throttling member 3, being cooled and brought to pressure $p_2$.

The cooled process fluid is used to cool the gas being treated by evaporator 4 which, as previously illustrated, is associated with drying device 10, forming heat exchanger 11, as previously illustrated.

The cooling circuit is then closed by again sending the process fluid, which is at a temperature slightly higher than that of the saturated vapour at pressure $p_2$ after heat exchange, to compressor 1.

In addition to the abovementioned components, apparatus 100 comprises a device 5 for regulating the flow of process fluid located in the portion of the circuit of apparatus 100 connecting exchanger 4 to compressor 1, a process fluid separator 6 downstream from regulating device 5 and a filter 7, preferably between condenser 2 and first throttling member 3.

In addition to this, the apparatus 100 further comprises a plurality of pressure switches 8, which are for example associated with a high and low pressure control or the drive for a fan in condenser 2.

Figure 2:
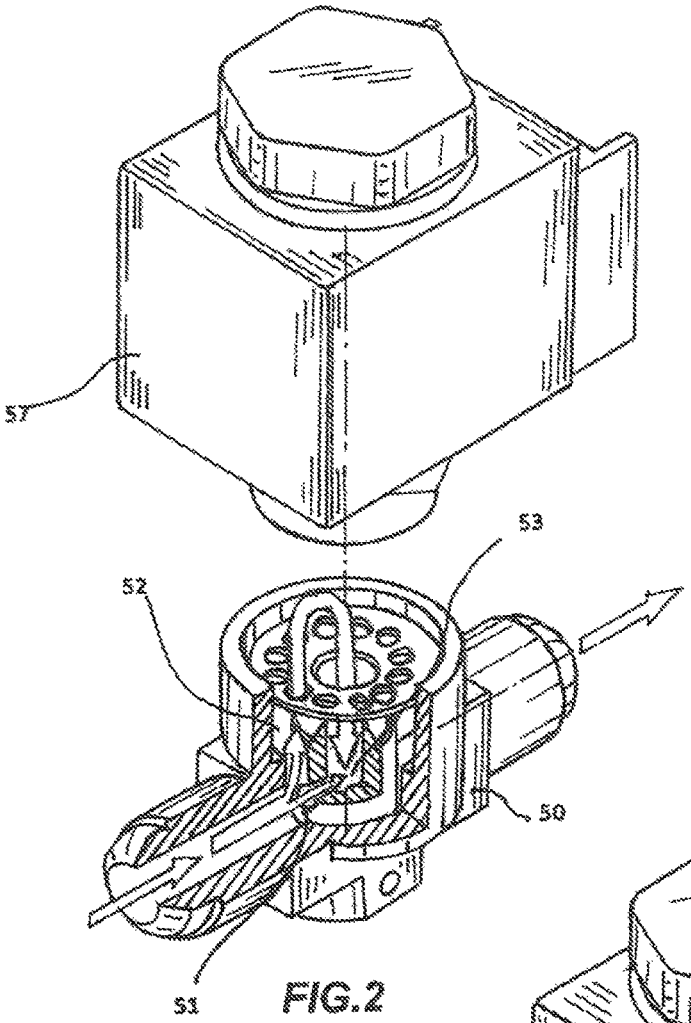
FIG. 2 is a diagrammatical illustration of an apparatus for the cooling of a process fluid and the drying device associated therewith according to an embodiment of this invention.
Figure 3:
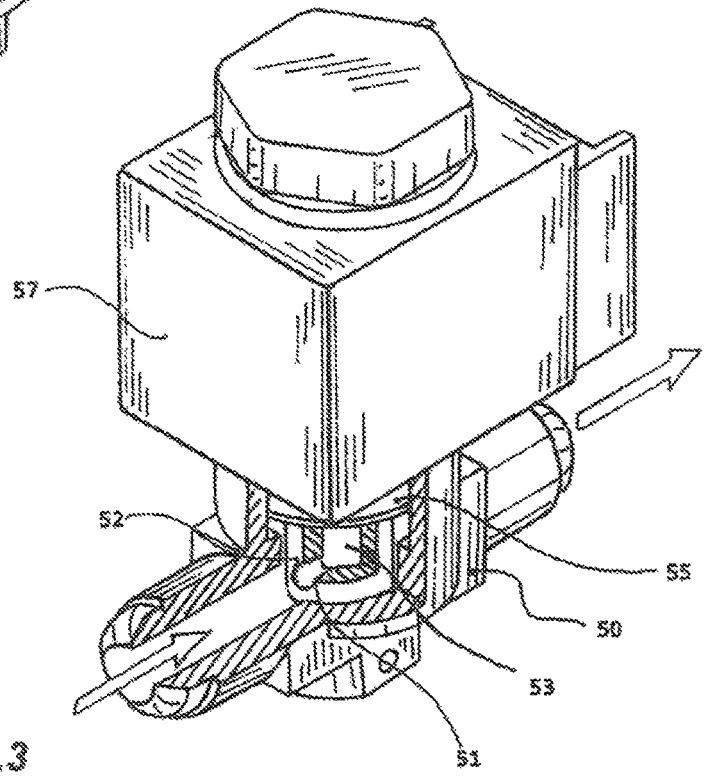
FIG. 3 is a graph showing the value of the temperature of the gas being treated as a function of time, which illustrates the functioning of the apparatus according to an embodiment of this invention.
Figure 4:
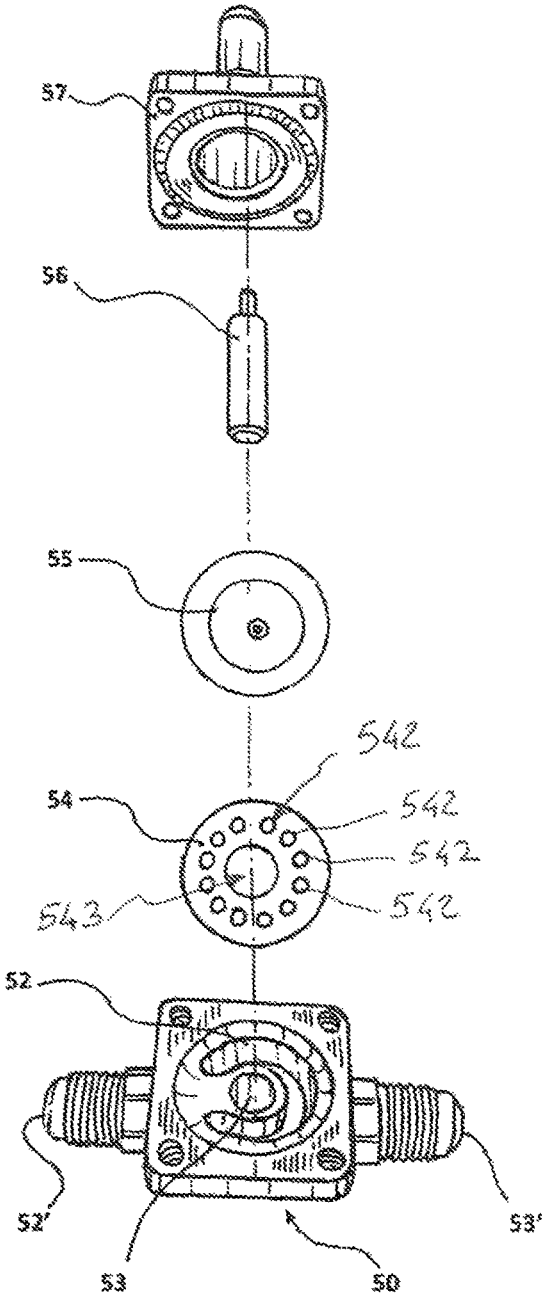
FIG. 4 is a diagrammatical illustration of a second embodiment of the apparatus for cooling a process fluid according to this invention.
Figure 4A:
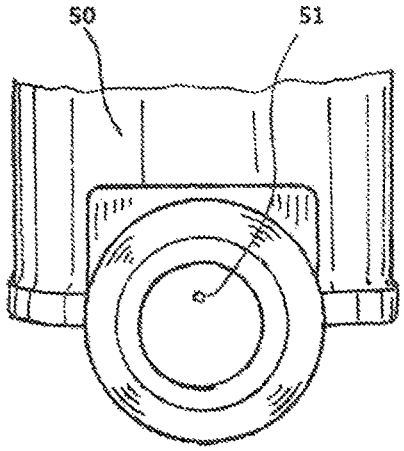
Figure 4B:
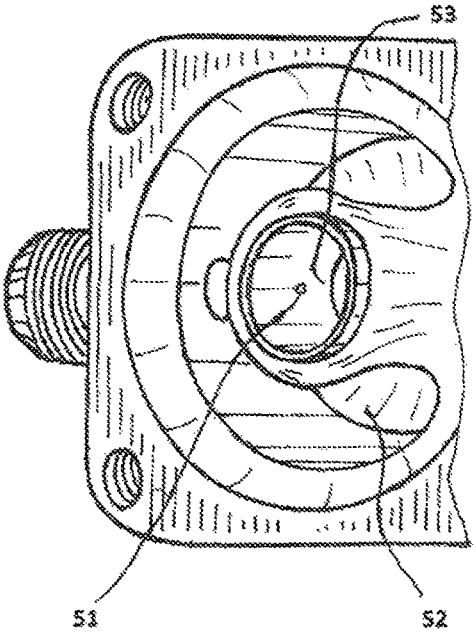

With reference therefore to FIGS. 2 to 4, regulating device 5 preferably takes the form of an electromagnetically controlled valve.

Valve 5 comprises a valve body 50 in which there is defined an inlet chamber 52 and an outlet chamber 53. Preferably inlet chamber 52 extends around the perimeter of outlet chamber 53 and they are connected to corresponding inlet section 52' and outlet section 53' of valve 5, and can be connected to the process fluid circuit of apparatus 100.

Valve 5 also comprises a shutter 55, connected to a magnetic element 56, activated by a coil not illustrated in the figure, housed within an enclosing body 57.

Preferably, valve 5 also comprises a distributor disc 54 located between inlet chamber 52 and shutter 55 which makes it possible to define a main passage between inlet chamber 52 and outlet chamber 53 through which the operating fluid passes when the valve 5 is in an open position.

In greater detail, distributor disc 54 has a central opening 543 facing outlet chamber 53 and a plurality of peripheral holes 542 facing inlet chamber 52.

In this way fluid can flow within the valve 5 in a precise and uniform way, thus allowing optimum control of heat exchange.

The valve 5 according to one embodiment of this invention further comprises a calibrated passage hole 51 which provides further communication between inlet chamber 52 and outlet chamber 53 and remains open regardless of the operating position of shutter 55. It should be noted that in the context of this invention the term "calibrated" means that calibrated passage hole 51 has specific dimensions which make it possible to introduce a predetermined head loss and as a consequence control the throughput of operating fluid.

As mentioned previously, in this embodiment outlet chamber 53 is of a substantially cylindrical shape and inlet chamber 52 extends around the perimeter of the outlet chamber in a C-shape. Calibrated passage hole 51 is preferably made in a separating wall between the two chambers 52 and 53 and is advantageously in line with the openings defining inlet section 52' and outlet section 53'.

In this embodiment valve 5 is of the type which is normally closed, that is when the magnet is not excited by the coil shutter 55 closes off the main passage between the inlet chamber 52 and the outlet chamber 53. However, even in this position, passage of fluid is permitted through calibrated passage hole 51, which because of its small dimensions will produce a head loss. As a consequence, a limited throughput in comparison with that which passes through the distributor disc 54 when the valve 5 is in the open position is allowed to pass through calibrated passage hole 51.

Vice versa, when valve 5 is open the main passage through distributor disc 54 is opened up and as a consequence the operating fluid mainly passes via that route.

It should in fact be noted that the dimensions of the main passage with respect to the calibrated passage hole 51 are such that the throughput of operating fluid through the calibrated passage hole 51 is minimal under conditions in which the valve 5 is open. This is essentially due to the head loss to which the fluid is subjected during passage through the calibrated passage hole 51, which makes passage through the main passage of the valve 5 preferred.

As a consequence, functioning of the apparatus 100 according to an embodiment of this invention may be switched between two operating modes, for example through a control unit 9, a first in which a nominal throughput of the operating fluid is delivered to the compressor 1, typically corresponding to the throughput for which the compressor 1 is dimensioned, and a second mode in which it is delivered with a reduced throughput.

According to a preferred embodiment, control unit 9 operates valve 5 on the basis of a parameter characteristic of the thermal level of the gas requiring treatment in drying device 10. It is obvious that in the case of different applications the parameter considered may not be the same, provided that it is related to the temperature of the air or other fluid or gas being treated, with which the process fluid exchanges heat.

In particular, control of the thermal level of the air which has to be dried—or other gas requiring treatment—will make it possible to monitor the required load, understood as the quantity of heat which has to be removed from the gas being treated in order to achieve drying in the drying device 10.

Preferably the characteristic function on the basis of which valve 5 will be switched is represented by a temperature value detected in heat exchanger 11.

When the load falls beneath a certain level and consequently the temperature found is less than a predetermined threshold, control unit 9 will close valve 5, causing the process fluid to pass through calibrated passage hole 51.

As a consequence the pressure in the cooling circuit will be reduced and there will be rarefaction of the gas drawn into the compressor 1, with a consequent reduction in the mass throughput through the compressor 1 and a consequent reduction in the cooling capacity in the evaporator 4 with a corresponding reduction in the electrical power consumed by the compressor 1, with a consequent saving of energy.

Closure of valve 5 and the consequent further choking off of the process fluid will therefore make it possible to control the flows to the evaporator 4 and therefore the temperature of the gas being treated, preventing it from falling to excessively low values incompatible with drying device 10. The procedure for opening and closing regulating device 5 may also be modulated on the basis of very close regular pulses (duty-cycle) thus achieving very precise regulation of the cooling capacity as the load of air which has to be dried is varied, with an energy consumption which is more consistent with the requirement for cooling.

It will also be noted that regulating device 5 may also take the form of a valve which is normally open, the stages of excitation of the coil and therefore opening and closing of the shutter 55 being controlled in a different way.

The invention thus resolves the problem set forth, at the same time conferring a plurality of advantages, including the possibility of modulating the throughput of coolant drawn into the compressor 1, thus making it possible to control its cooling capacity. In this way it is therefore possible to manage the throughput provided by the compressor 1 and therefore the thermal load produced by the drying device 10 on the basis of the demand for dried compressed air. In addition to this, and in addition to permitting a specified loss of head, the calibrated passage hole 51 ensures that any traces of liquid are expanded while overheating at the outlet of the evaporator 4 is not guaranteed. Also the valve 5 may easily be constructed through a simple modification to commercial valves without therefore requiring special manufacturing costs.

The invention claimed is:

1. An apparatus for the dehumidification of a gas, comprising a cooling circuit for a process fluid along which are successively arranged:

(a) a compressor;

(b) a condenser;

(c) a first throttling member;

(d) an evaporator which forms a heat exchanger for performing a heat exchange with the gas to be treated, so as to dehumidify the gas; and (e) a regulating device having an inlet chamber and an outlet chamber, a main process fluid passage, which can be selectively closed by a movable shutter, being formed between the inlet chamber and the outlet chamber, and a calibrated passage hole which provides additional communication between the inlet chamber and the outlet chamber, wherein the inlet chamber extends around the perimeter of the outlet chamber and the inlet chamber and outlet chamber are each connected to a corresponding inlet section and an outlet section, respectively, which can be connected to the process fluid circuit, the inlet chamber and the outlet chamber being separated from each other by a distributor disc which has a central opening facing the outlet chamber and a plurality of peripheral holes facing the inlet chamber.

2. The apparatus according to claim 1, wherein the regulating device is located upstream of the compressor.

3. The apparatus according to claim 1, further comprising a condensate separator positioned downstream of the heat exchanger for the dehumidification of the gas to be treated.

4. The apparatus according to claim 1, further comprising a process fluid separator positioned downstream of the regulating device.

5. The apparatus according to claim 1, wherein the regulating device is an electromagnetically operated valve.

6. The apparatus according to claim 1, further comprising a control unit adapted to switch the apparatus between two operating modes, a first mode in which a nominal throughput of the process fluid is delivered to the compressor and a second mode in which the process fluid is delivered with a reduced throughput.

7. The apparatus according to claim 1, in which the calibrated passage hole is made in a wall separating the inlet chamber from the outlet chamber and is in line with corresponding openings which define the inlet section and the outlet section.

8. The apparatus according to claim 1, wherein the outlet chamber has a substantially cylindrical shape and the inlet chamber extends around the perimeter of the outlet chamber in a C-shape.

9. A drying system for a compressed gas comprising:

an apparatus for the dehumidification treatment of the gas, the apparatus including a cooling circuit for a process fluid along which are successively arranged (a) a compressor, (b) a condenser, (c) a first throttling member, (d) an evaporator which forms a heat exchanger for performing a heat exchange with the gas to be treated so as to dehumidify the gas; and (e) a regulating device having an inlet chamber and an outlet chamber, a main process fluid passage, which can be selectively closed by a movable shutter, being formed between the inlet chamber and the outlet chamber, and a calibrated passage hole which provides additional communication between the inlet chamber and the outlet chamber, wherein the inlet chamber extends around the perimeter of the outlet chamber and the inlet chamber and outlet chamber are each connected to a corresponding inlet section and an outlet section which can be connected to the process fluid circuit, the inlet chamber and the outlet chamber being separated from each other by a distributor disc which has a central opening facing the outlet chamber and a plurality of peripheral holes facing the inlet chamber; and a drying device having an inlet for the gas being treated and an outlet for the treated gas, the drying device including the heat exchanger defined by the evaporator and a condensate separator provided at the outlet from the heat exchanger.

10. The drying system according to claim 9, wherein the regulating device is located upstream of the compressor.

11. The drying system according to claim 9, further comprising a process fluid separator positioned downstream of the regulating device.

12. The drying system according to claim 9, wherein the regulating device is an electromagnetically operated valve.

13. The drying system according to claim 9, further comprising a control unit adapted to switch the apparatus between two operating modes, a first mode in which a nominal throughput of the process fluid is delivered to the compressor and a second mode in which the process fluid is delivered with a reduced throughput.

14. The drying system according to claim 9, in which the calibrated passage hole is made in a wall separating the inlet chamber from the outlet chamber and is in line with corresponding openings which define the inlet section and the outlet section.

15. The drying system according to claim 9, wherein the outlet chamber has a substantially cylindrical shape and the inlet chamber extends around the perimeter of the outlet chamber in a C-shape.

16. An apparatus for the dehumidification of a gas, comprising a cooling circuit for a process fluid along which are successively arranged:

(a) a compressor;

(b) a condenser;

(c) a first throttling member;

(d) an evaporator which forms a heat exchanger for performing a heat exchange with the gas to be treated, so as to dehumidify the gas;

(e) a condensate separator positioned downstream of the heat exchanger for the dehumidification of the gas to be treated;

(f) a process fluid separator;

(g) a control unit adapted to switch the apparatus between two operating modes, a first mode in which a nominal throughput of the process fluid is delivered to the compressor and a second mode in which the process fluid is delivered with a reduced throughput; and (h) a regulating device located upstream of both the compressor and the process fluid separator and having an inlet chamber and an outlet chamber, a main process fluid passage, which can be selectively closed by a movable shutter, being formed between the inlet chamber and the outlet chamber, and a calibrated passage hole which provides additional communication between the inlet chamber and the outlet chamber, wherein the inlet chamber extends around the perimeter of the outlet chamber and the inlet chamber and outlet chamber are each connected to a corresponding inlet section and an outlet section, respectively, which can be connected to the process fluid circuit, the inlet chamber and the outlet chamber being separated from each other by a distributor disc which has a central opening facing the outlet chamber and a plurality of peripheral holes facing the inlet chamber.

17. The apparatus according to claim 16, wherein the regulating device is an electromagnetically operated valve.

18. The apparatus according to claim 16, in which the calibrated passage hole is made in a wall separating the inlet chamber from the outlet chamber and is in line with corresponding openings which define the inlet section and the outlet section.

19. The apparatus according to claim 16, wherein the outlet chamber has a substantially cylindrical shape and the inlet chamber extends around the perimeter of the outlet chamber in a C-shape.

20. The apparatus according to claim 16, wherein the process fluid is a refrigerant.

* * * * *